United States Patent [19]

Kawai

[11] 4,453,479

[45] Jun. 12, 1984

[54] HORIZONTALLY ROTATING LOOPTAKER FOR A SEWING MACHINE

[75] Inventor: Yoshihiro Kawai, Aichi, Japan

[73] Assignee: Aisin Seiki Kabushiki Kaisha, Kariya, Japan

[21] Appl. No.: 347,617

[22] Filed: Feb. 10, 1982

[30] Foreign Application Priority Data

Feb. 13, 1981 [JP] Japan ..... 56-20563

[51] Int. Cl.[3] ..... D05B 57/16; D05B 57/20

[52] U.S. Cl. ..... 112/231

[58] Field of Search ..... 112/181, 183, 184, 228, 112/229, 230, 231

[56] References Cited

U.S. PATENT DOCUMENTS

| | | | |
|---|---|---|---|
| 2,320,316 | 5/1943 | Wertz | 112/228 |
| 2,394,369 | 2/1946 | Colegrove | 112/228 |
| 2,763,226 | 9/1956 | Goebel | 112/184 |
| 3,379,150 | 4/1968 | Johnson | 112/228 |
| 3,416,472 | 12/1968 | Johnson | 112/228 X |
| 4,331,090 | 5/1982 | Hanyu et al. | 112/229 |

FOREIGN PATENT DOCUMENTS

| | | | |
|---|---|---|---|
| 167583 | 4/1956 | Australia | 112/231 |
| 30676 | 5/1960 | Finland | 112/228 |
| 536217 | 11/1955 | Italy | 112/231 |
| 536218 | 11/1955 | Italy | 112/231 |
| 578664 | 6/1958 | Italy . | |

*Primary Examiner*—Wm. Carter Reynolds

*Attorney, Agent, or Firm*—Sughrue, Mion, Zinn, Macpeak and Seas

[57] ABSTRACT

In a horizontally rotating looptaker for a sewing machine having a bobbin case mounted for relative rotation on a raceway within a rotating cup-shaped hook body a magnet is carried by the bobbin case adjacent the outer periphery thereof and a fixed member of magnetic material is disposed in close, non-contacting relation to said magnet to continuously bias said bobbin case into engagement with the raceway to prevent the occurrence of undesirable noise.

4 Claims, 2 Drawing Figures

FIG. 1
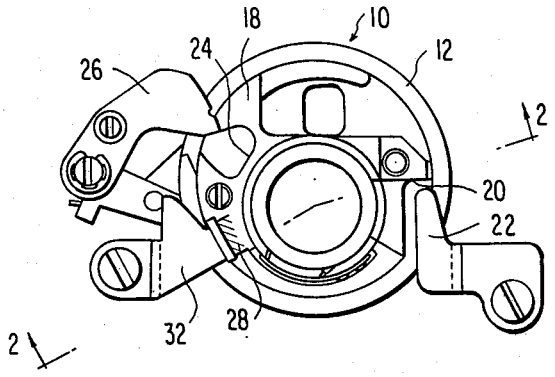
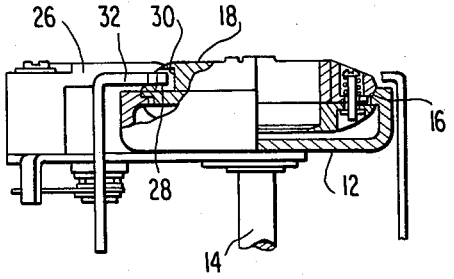
FIG. 2

HORIZONTALLY ROTATING LOOPTAKER FOR A SEWING MACHINE

BACKGROUND OF THE INVENTION

The present invention is directed to a horizontally rotating looptaker for a sewing machine and more specifically to magnetic means associated with the bobbin case so as to maintain the bobbin case in continuous sliding engagement with the raceway on the hook body.

In conventional horizontally rotating looptakers, undesirable noise is frequently generated during the casting of the needle thread loop about the bobbin case due to relative movement between the bobbin case and the cup-shaped hook body in which the bobbin case is located.

SUMMARY OF THE INVENTION

The present invention provides a new and improved horizontally rotating looptaker for a sewing machine wherein the aforementioned undesirable noise is eliminated.

The present invention provides a new and improved horizontally rotating looptaker for a sewing machine wherein magnetic means are provided in operative association with the bobbin case to hold the bobbin case in sliding engagement with the raceway of the rotating hook body. More specifically, a permanent magnet is carried by the bobbin case adjacent the periphery thereof for cooperation with an arm of magnetic material which extends over the hook body in close proximity to the magnet.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a top plan view of a horizontally rotating looptaker according to the present invention.

FIG. 2 is a side elevation view, partly in section, taken along the line 2—2 in FIG. 1.

DETAILED DESCRIPTION OF THE INVENTION

The horizontally rotating looptaker 10 as shown in the drawings is comprised of a cup-shaped hook body 12 which is connected to the shaft 14 for rotation by the sewing machine motor through a suitable drive train (not shown). The interior of the hook body 12 is provided with a circumferentially extending raceway 16 which supports the bobbin case 18 within the cup-shaped hook body 12. A notch 20 is provided in the bobbin case 18 and a retainer 22 extends into the notch 20 to prevent rotation of the bobbin case 18 as the hook body 12 rotates in the clockwise direction as viewed in FIG. 1. The bobbin case is provided with a second recess 24 which is adapted to receive the free end of an oscillating bobbin case opening lever 26 which is adapted to periodically rotate the bobbin case 18 slightly in a counterclockwise direction as viewed in FIG. 1 in the conventional manner.

A magnet 28 is secured in a recess 30 adjacent the upper peripheral edge portion of the bobbin case 18. The bobbin case 18 is preferably made of plastics material and the magnet 13 is secured within the cavity 30 by any suitable means such as an adhesive or the like. Alternatively, the magnet may be molded directly into the bobbin case 18. A member 32 of magnetic material adapted to be attracted to the magnet 28 is secured to the sewing machine body (not shown) and extends over the outer periphery of the hook body in close proximity to the magnet 28. The magnet 28 and the member 32 are spaced a sufficient distance from the bobbin case opener 26 so that the bobbin case opener 26 is not adversely attracted by the magnet 28. Due to the positioning of the magnet 28 and the member 32 of magnetic material the bobbin case 18 is continuously biased laterally into circumferential sliding engagement with the raceway 16 of the hook body 12 thereby preventing any undesirable movement of the bobbin case 18 relative to the raceway 16 which could lead to the creation of undesirable noise.

While the invention has been particularly shown and described with reference to a preferred embodiment thereof, it will be understood by those in the art that various changes in form and details may be made therein without departing from the spirit and scope of the invention.

What is claimed is:

1. A horizontally rotating looptaker for a sewing machine comprising a rotatable cup-shaped hook body having an inner raceway, a bobbin case mounted in said hook body on said raceway for rotation relative thereto, retaining means preventing rotation of said bobbin case with said rotatable hook body, means for periodically oscillating said bobbin case relative to said hook body and magnetic means for biasing said bobbin case laterally into circumferential sliding engagement with said raceway to prevent undesirable movement of said bobbin case.

2. A horizontally rotating looptaker for a sewing machine as set forth in claim 1, wherein said magnetic means is comprised of a permanent magnet carried by said bobbin case and a fixed member of magnetic material disposed in closely spaced relation to said magnet.

3. A horizontally rotating looptaker for a sewing machine as set forth in claim 2, wherein said magnet is spaced from said means for periodically oscillating said bobbin case relative to said hook body.

4. A horizontally rotating looptaker for a sewing machine as set forth in claim 2, wherein said bobbin case is made of plastics material, said magnet being secured within said plastics material.

* * * * *